US010717497B2

(12) United States Patent
Yoder

(10) Patent No.: US 10,717,497 B2
(45) Date of Patent: Jul. 21, 2020

(54) EXPANDABLE PONTOON BOAT

(71) Applicant: LIPPERT COMPONENTS, INC., Elkhart, IN (US)

(72) Inventor: Carl Yoder, Millersburg, IN (US)

(73) Assignee: LIPPERT COMPONENTS, INC., Elkhart, IN (US)

( * ) Notice: Subject to any disclaimer, the term of this patent is extended or adjusted under 35 U.S.C. 154(b) by 0 days.

(21) Appl. No.: 16/178,770

(22) Filed: Nov. 2, 2018

(65) Prior Publication Data

US 2019/0135377 A1 May 9, 2019

Related U.S. Application Data

(60) Provisional application No. 62/583,667, filed on Nov. 9, 2017.

(51) Int. Cl.

| | |
|---|---|
| ***B63B 1/14*** | (2006.01) |
| ***B63B 7/04*** | (2020.01) |
| ***B63B 35/34*** | (2006.01) |

(52) U.S. Cl.

CPC ..... *B63B 1/14* (2013.01); *B63B 7/04* (2013.01); *B63B 35/34* (2013.01); *B63B 2001/145* (2013.01)

(58) Field of Classification Search

CPC ..... B63B 35/34; B63B 7/04; B63B 1/14

See application file for complete search history.

(56) References Cited

U.S. PATENT DOCUMENTS

| | | | | |
|---|---|---|---|---|
| 2,850,747 | A * | 9/1958 | Bouchard, Sr. | B63C 13/00 114/344 |
| 2,992,444 | A | 7/1961 | Schuler | |
| 3,673,622 | A | 7/1972 | Allen | |
| 3,800,726 | A * | 4/1974 | Murphy | B63B 2035/4426 114/61.22 |
| 3,846,858 | A * | 11/1974 | Syfritt | B63B 7/085 114/354 |
| 3,930,274 | A * | 1/1976 | Syfritt | B63B 7/085 114/354 |
| 4,766,830 | A * | 8/1988 | Kunz | B63B 1/121 114/127 |
| 4,909,169 | A | 3/1990 | Skandaliaris et al. | |

(Continued)

FOREIGN PATENT DOCUMENTS

WO WO 2018/014112 1/2018

OTHER PUBLICATIONS

Boat Models—Island Boats, "Wider and Narrower," accessed on-line at URL:http://islandboats.com/boat-models/. Publication date unknown. May have been published as early as the year 2014.

(Continued)

*Primary Examiner* — Lars A Olson
*Assistant Examiner* — Jovon E Hayes
(74) *Attorney, Agent, or Firm* — Nixon & Vanderhye P.C.

(57) ABSTRACT

An expandable pontoon boat includes a center section, a first side section, and a second side section. First and second telescoping assemblies connect the first side section to the center section, and third and fourth telescoping assemblies connect the second side section to the center section. The telescoping assemblies may be extended and retracted to extend and retract the first and second side sections from the center section, thereby widening and narrowing the boat, respectively.

17 Claims, 13 Drawing Sheets

(56) References Cited

U.S. PATENT DOCUMENTS 5,313,908 A * 5/1994 Kunz ..... B63B 7/082 114/354
5,474,009 A 12/1995 Ritchie et al.
5,522,339 A * 6/1996 Pelly ..... B63B 1/12 114/354
5,758,918 A 6/1998 Schneider et al.
5,765,316 A 6/1998 Kavarsky
6,003,458 A 12/1999 Valliere
6,067,925 A * 5/2000 Little ..... B63B 1/125 114/354
6,234,098 B1 5/2001 Biedenweg et al.
6,298,802 B1 * 10/2001 Brignolio ..... B63B 7/02 114/344
6,439,145 B1 * 8/2002 Mensch ..... B63C 13/00 114/344
6,640,737 B2 * 11/2003 Chacon ..... B63B 1/121 114/354
6,647,913 B2 * 11/2003 Brignolio ..... B63B 1/12 114/344
6,990,915 B2 * 1/2006 Smith ..... B63B 1/14 114/61.16
7,258,389 B2 8/2007 Franzini
8,539,899 B2 * 9/2013 Gimpel ..... B60P 3/1033 114/344
8,820,255 B1 9/2014 Poppell et al.
9,016,220 B2 * 4/2015 Gariepy ..... B63B 5/24 114/61.15
9,045,195 B2 6/2015 Poppell
9,085,347 B2 7/2015 Antonelli
9,156,526 B2 10/2015 Handley
9,580,149 B2 2/2017 Poppell et al.
9,845,135 B2 12/2017 Handley
10,029,761 B2 7/2018 Poppell et al.
2002/0088388 A1 * 7/2002 Mensch ..... B63C 13/00 114/344
2003/0154901 A1 8/2003 Carter
2004/0184883 A1 * 9/2004 Basta ..... B63C 3/00 405/3
2005/0214093 A1 * 9/2005 Priesgen ..... B60P 1/435 410/104
2011/0247538 A1 * 10/2011 Gimpel ..... B60P 3/1033 114/61.1
2014/0261140 A1 9/2014 Poppell et al.
2018/0099726 A1 4/2018 Broadway et al.
2019/0135377 A1 * 5/2019 Yoder ..... B63B 1/14

OTHER PUBLICATIONS

"Island Boats Retractable & Expandable Pontoon Boats," screenshot of YouTube video accessed on-line at URL: https://www.youtube.com/watch?v=mAu-UM9ZACk (Feb. 10, 2016).

* cited by examiner

EXPANDABLE PONTOON BOAT

CROSS-REFERENCE TO RELATED APPLICATION

This application claims benefit under 35 U.S.C. § 119 of U.S. Provisional Patent Application No. 62/583,667, filed on Nov. 9, 2017, and incorporates by reference the disclosure thereof in its entirety.

BACKGROUND AND SUMMARY OF THE DISCLOSURE

Pontoon boats are known in the art. A pontoon boat typically includes first and second pontoons, a plurality of cross members fixedly connecting the pontoons together, and a floor or deck disposed atop the cross members. The deck may support a captain's station, seating for passengers, and a railing about the perimeter of the deck.

A pontoon boat typically is generally rectangular, having a length and a width. The length may be selected as desired. The width, however, may be practically limited, for example, by transportation and storage considerations. More specifically, federal highway regulations generally limit the width of a trailer towed on public highways to 102" and require special permits for towing trailers wider than that. These regulations effectively limit the width of a pontoon boat to 102". Also, available space at a dock, on a boat lift, or at a dry storage facility may practically limit the width of a pontoon boat.

The present disclosure is directed to a pontoon boat having a variable width, and to operating mechanisms for varying the width of the boat.

DETAILED DESCRIPTION OF THE DRAWINGS

Figure 1A:
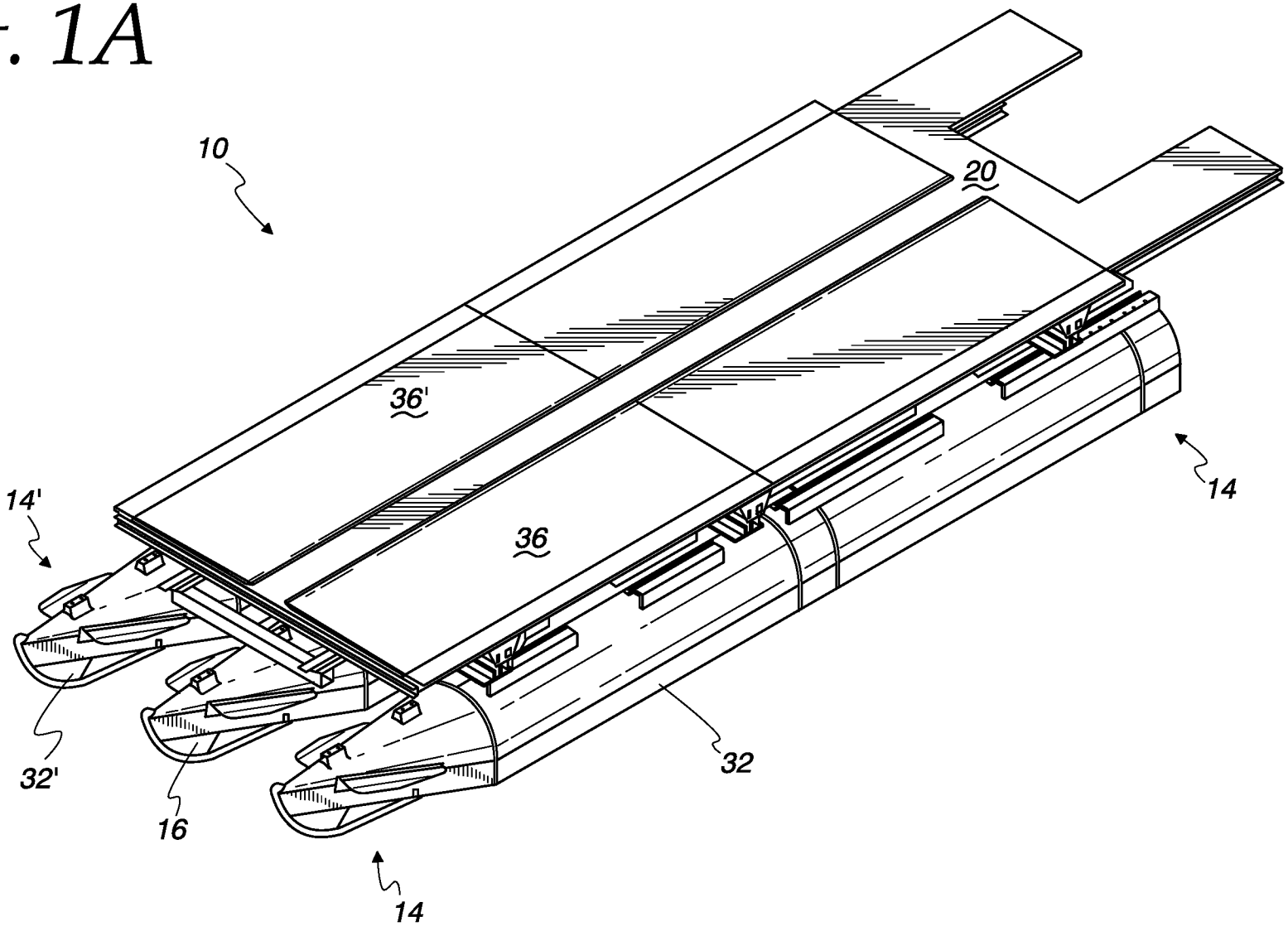
FIG. 1A is a perspective view of an expandable pontoon boat according to the present disclosure in a collapsed configuration.
Figure 1B:
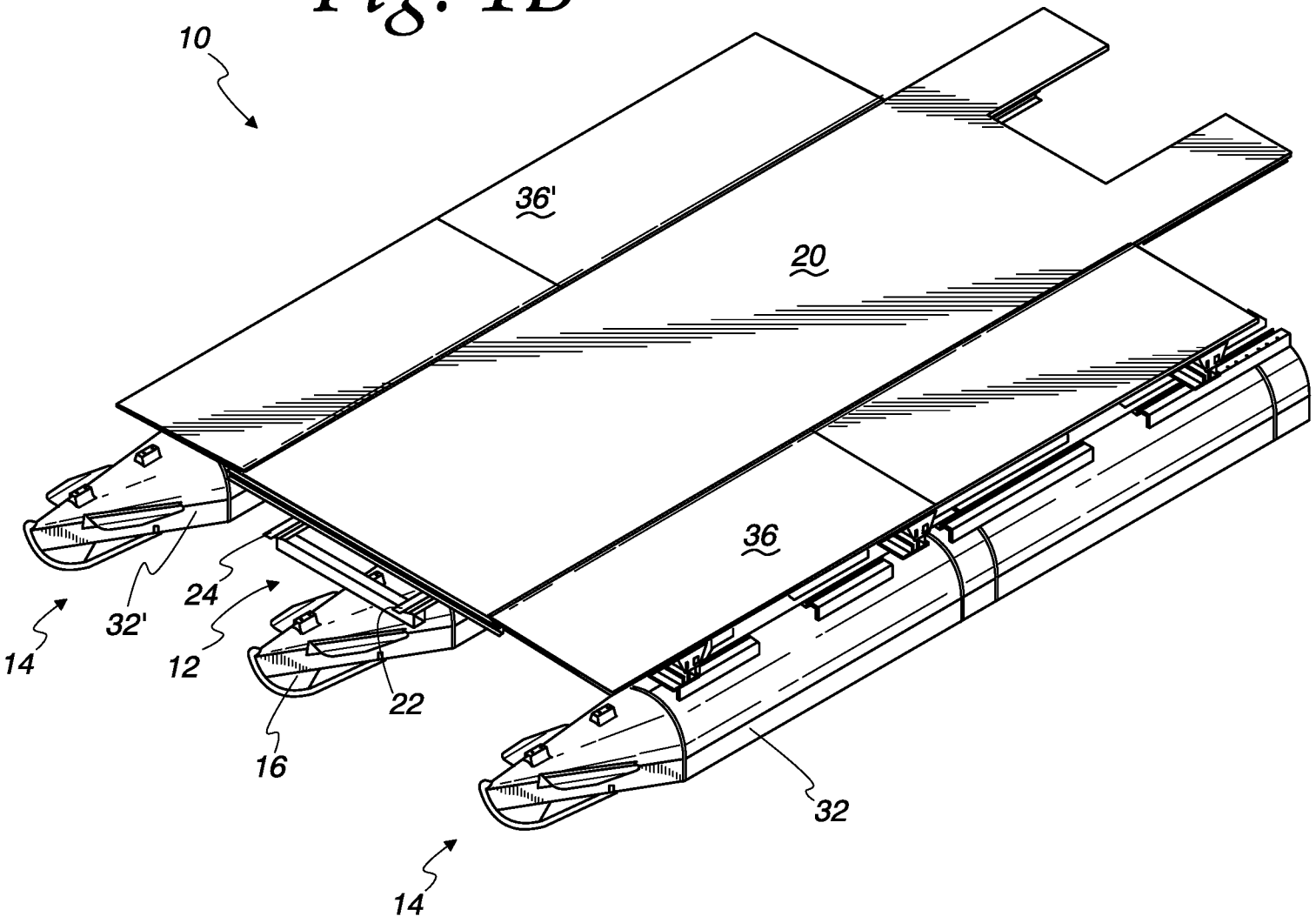
FIG. 1B is a perspective view of the expandable pontoon boat of FIG. 1A in an expanded configuration.
Figure 2A:
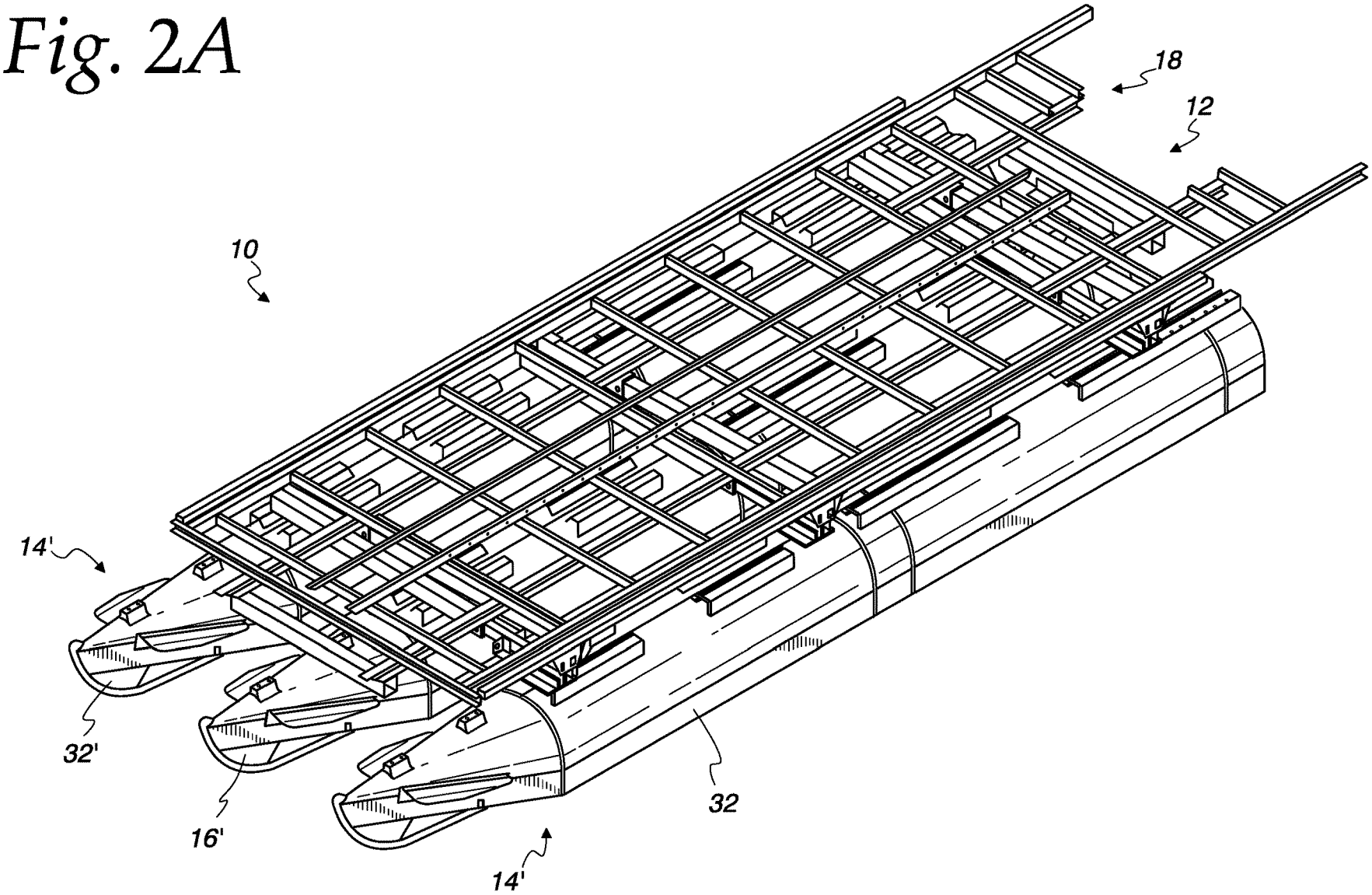
FIG. 2A is a perspective view of the expandable pontoon boat of FIG. 1A in a collapsed configuration with the decking removed for clarity.
Figure 2B:
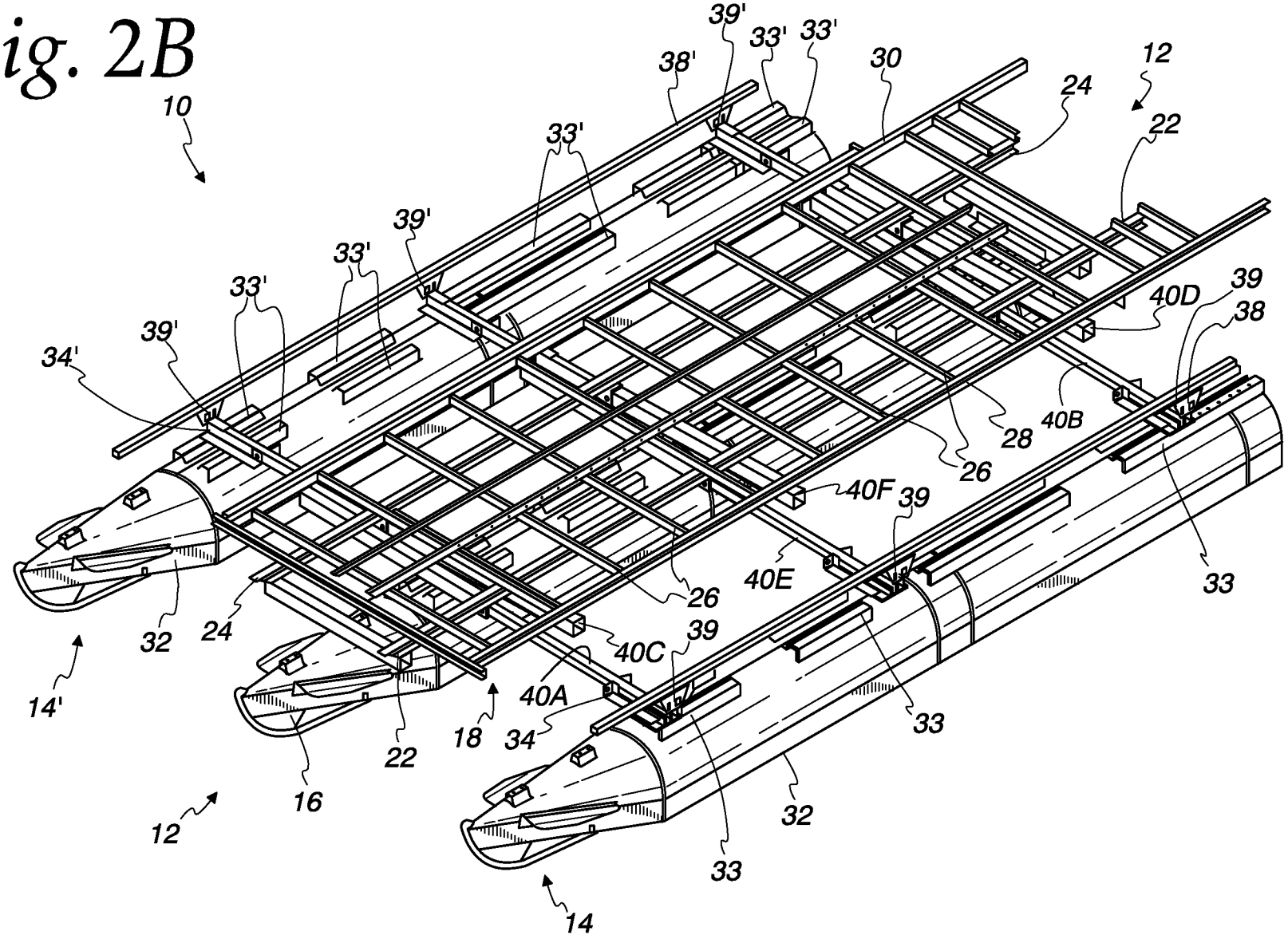
FIG. 2B is a perspective view of the expandable pontoon boat of FIG. 1A in an expanded configuration with the decking removed for clarity.
Figure 3A:
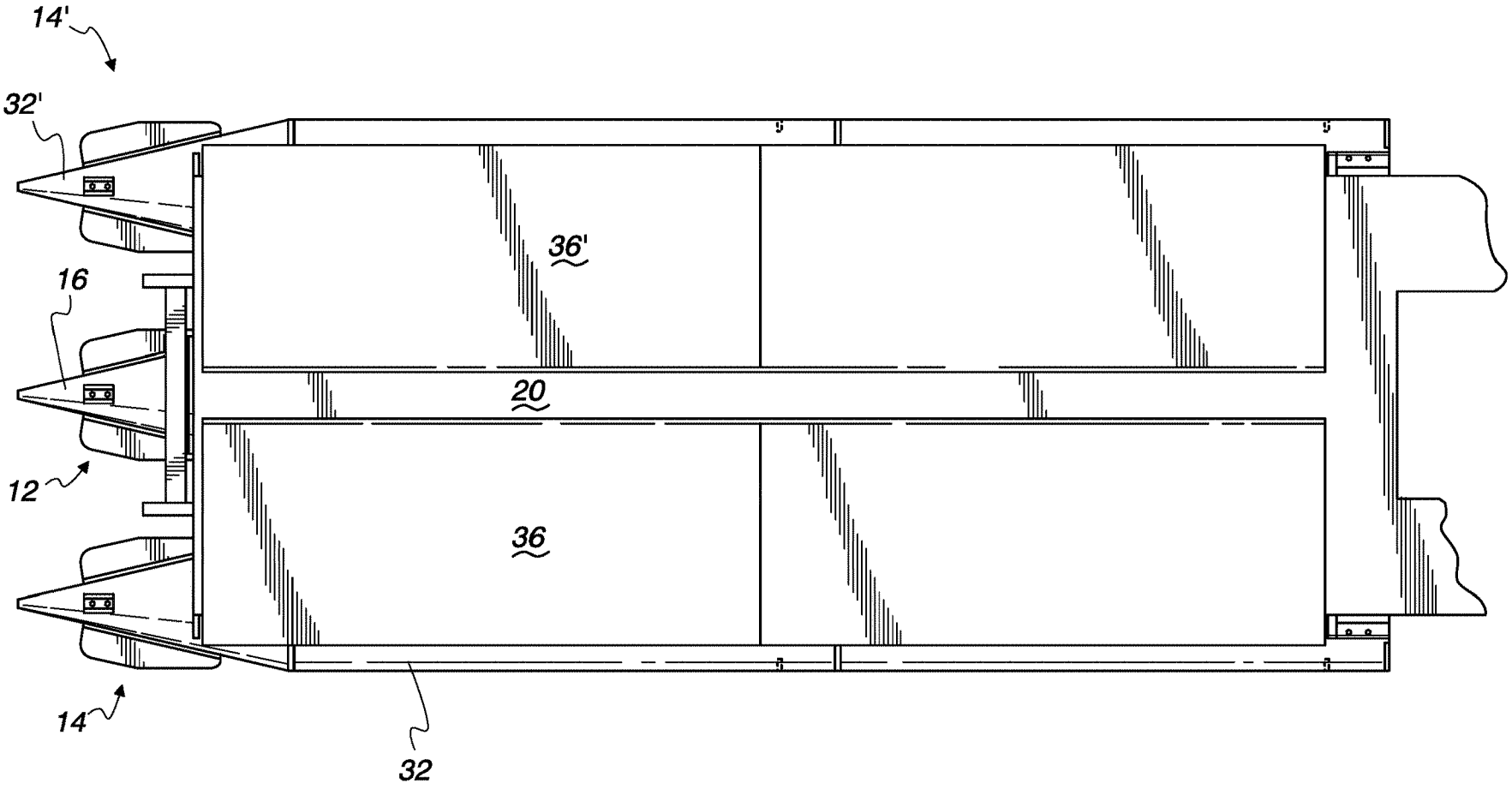
FIG. 3A is a top plan view of the expandable pontoon boat of FIG. 1A in a collapsed configuration.
Figure 3B:
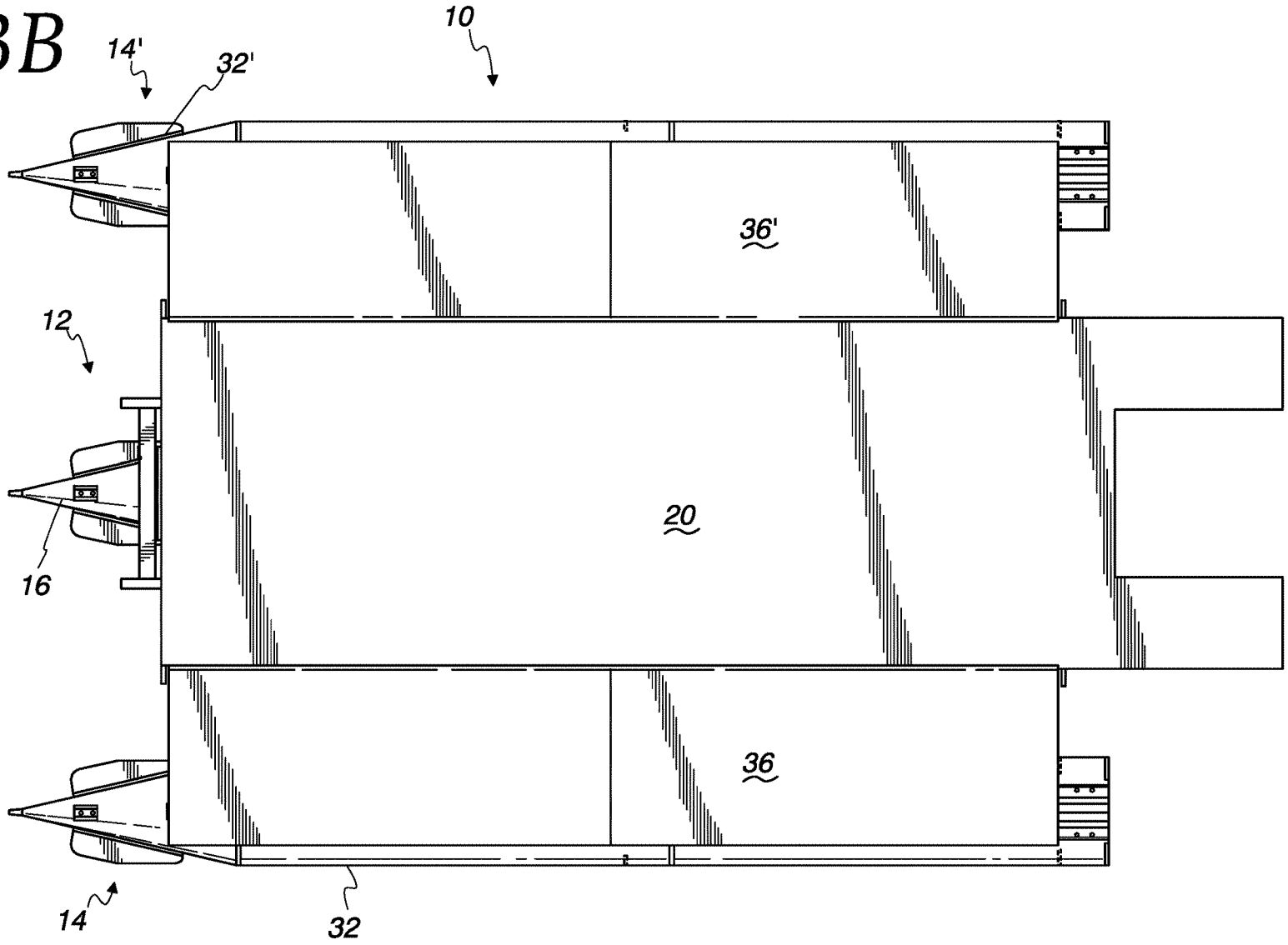
FIG. 3B is a top plan view of the expandable pontoon boat of FIG. 1A in an expanded configuration.

The drawings show an illustrative embodiment of a pontoon boat 10 according to the present disclosure. The pontoon boat 10 includes a center section 12, a first side (or port) section 14, and a second side (or starboard) section 14'.

The center section 12 includes a frame 18 and a center deck 20 overlying and connected to the frame. The frame 18 includes a first longitudinal main rail 22 and a second longitudinal main rail 24 spaced from and generally parallel to the first main rail. A plurality of spaced apart and generally parallel cross members 26 are fixedly connected to the first and second main rails 22, 24, for example, to respective upper surfaces of the main rails. As shown, each of the cross members 26 may be generally perpendicular to the first and second rails 22, 24. A first generally longitudinal side rail 28 is fixedly connected to each of the cross members 26 at or near respective first ends thereof, and a second generally longitudinal side rail 30 is fixedly connected to each of the cross members 26 at or near respective second ends thereof. As shown, the pontoon boat 10 also may include an optional center pontoon 16 associated with the center section 12.

The port section 14 and the starboard section 14' may be mirror images of each other. As such, only the port section 14 will be discussed in detail herein.

The port section 14 includes an elongated first side (or port) pontoon 32, a plurality of first side (or port) pontoon mounting sleeves 34, a first side (or port) deck 36, a first side (or port) deck support 38, and a plurality of first side (or port) deck support brackets 39. The port pontoon 32 has a longitudinal axis and a peripheral surface extending generally the length of the port pontoon. Each of the port pontoon mounting sleeves 34 is connected to a corresponding upper portion of the peripheral surface of the port pontoon 32, either directly or through an intervening structure, for example a first side (or port) pontoon riser 33. As shown, each of the port pontoon mounting sleeves 34 may be embodied as a tube having a square cross section and a longitudinal axis generally perpendicular to the longitudinal axis of the port pontoon 32. In the embodiment shown, each of the port deck support brackets 39 is embodied as a bracket connected at a first end to a corresponding one of the port pontoon mounting sleeves 34, and at a second end to a first (or outboard) side of the port deck support 38. A first (or outboard) end of the port deck 36 may be connected to the port deck support 38. In other embodiments, any or all of the port deck support brackets 39 could be connected at the corresponding first ends thereof directly to the port pontoon 32 or to an intervening bracket or other structure. Also, any or all of the port deck support brackets 39 could be connected at the corresponding second ends thereof directly to the port deck 36, and the port deck support 38 could be omitted. Any or all of the port deck support brackets 39, the port deck support 38, the connection therebetween, or the connection between the port deck and the deck support brackets or the port deck support may be sufficiently flexible to allow for some articulation of the port deck 36 and port deck support 38 with respect to the port pontoon 32, as will be discussed further below.

As mentioned above, the starboard section 14' is similarly configured. Components of the starboard section 14' having counterparts in the port section 14 may be described herein using like terminology with reference to "second side" or "starboard" instead of "first side" or "port", and they may be identified in the drawings using like but primed reference characters. For example, the starboard section 14' is shown as including a starboard pontoon 32' analogous to the port pontoon 32 and a plurality of starboard pontoon mounting sleeves 34' analogous to the port pontoon mounting sleeves 34 attached thereto.

The port section 14 is connected to the center section 12 by a first telescoping assembly 40A proximate respective first (or forward) portions of the port section and the center section, and by a second telescoping assembly 40B proximate respective second (or rearward or aft) portions of the port section and the center section. The starboard section 14' is connected to the center section 12 by a third telescoping assembly 40C proximate respective first (or forward) portions of the starboard section and the main section, and by a fourth telescoping assembly 40D proximate respective second (or rearward or aft) portions of the starboard section and the center section.

In the illustrated embodiment, the port section 14 is further connected to the center section 12 by a fifth telescoping assembly 40E intermediate the first telescoping assembly 40A and the second telescoping assembly 40B, and the starboard section 14' is further connected to the center section by a sixth telescoping assembly 40F intermediate the third telescoping assembly 4C and the fourth telescoping assembly 40D. In other embodiments, either or both of the fifth telescoping assembly 40E and the sixth telescoping assembly 40F may be omitted. In further embodiments, one or more additional telescoping assemblies 40*n* may be provided connecting either or both of the port section 14 and the starboard section 14' to the center section 12.

The first, second, and fifth telescoping assemblies 40A, 40B, 40E may be substantially identical to each other, and the third, fourth, and sixth telescoping assemblies 40C, 40D, 40F may be substantially the mirror image of the first telescoping assembly 40A. As such, only the first telescoping assembly 40A will be described herein in detail. Components of the second, third, fourth, fifth, and sixth telescoping assemblies 40B, 40C, 40D, 40E, 40F having counterparts in the first telescoping assembly 40A may be described herein using like terminology, and they may be identified in the drawings by like reference characters with a corresponding alpha suffix.

The first telescoping assembly 40A includes an outer tube 52A and an inner tube (or ram) 54A slidingly received within the outer tube. In the embodiment shown, the outer tube 52A is fixedly connected to the underside of each of the first and second main rails 22, 24 of the frame 18 of the main section 12. The outer tube 52A may be connected to the first and second main rails 22, 24 directly or through one or more intervening structures. In the embodiment shown, the outer tube 52A spans substantially the entire width of the frame 18 of the main section 12. In other embodiments, the outer tube 52A may be connected to the first and second main rails 22, 24 in another manner, and it may span a greater or lesser portion of the width of the frame 18 of the main section 12. The inner tube 54A is fixedly connected to a corresponding port pontoon sleeve 34. For example, as shown, the inner tube 54A is slidingly received within the corresponding port pontoon sleeve 34 and fixedly connected thereto using mechanical fasteners or otherwise. Though fixedly connected to the port pontoon sleeve 34, the inner tube 54A may be readily removed therefrom, thereby facilitating removal and replacement of the inner tube 54A from the outer tube 52A as may be necessary from time to time for maintenance or other purposes. In an embodiment, the port pontoon sleeve 34 may be omitted, and the inner tube 54A may be connected to the port pontoon 32 or to respective port pontoon risers 33 directly.

As shown, each of the telescoping assemblies 40A, 40B, 40C, 40D, 40E, 40F is connected to the center section 12 at an angle to a plane defined by the center section 12 or the frame 18 or center deck 20 thereof so that the port pontoon 32 and the starboard pontoon 32' may be extended both downwardly and outwardly from the center section, as will be discussed further below. As suggested above, spacers or other structures (not shown) may be disposed between the outer tubes 52*n* of the telescoping assemblies 40*n* and the main rails 22, 24 of the center section 12 to set the telescoping assemblies 40*n* at the foregoing angle with respect to the center section.

In embodiments including the optional center pontoon 16, as shown, the center pontoon may be connected to respective outer surfaces of the outer tubes 52 of the telescoping assemblies 40A, 40B, 40C, 40D, 40E, 40F, either directly, or through intervening risers analogous to the port risers 33.

Figure 8:
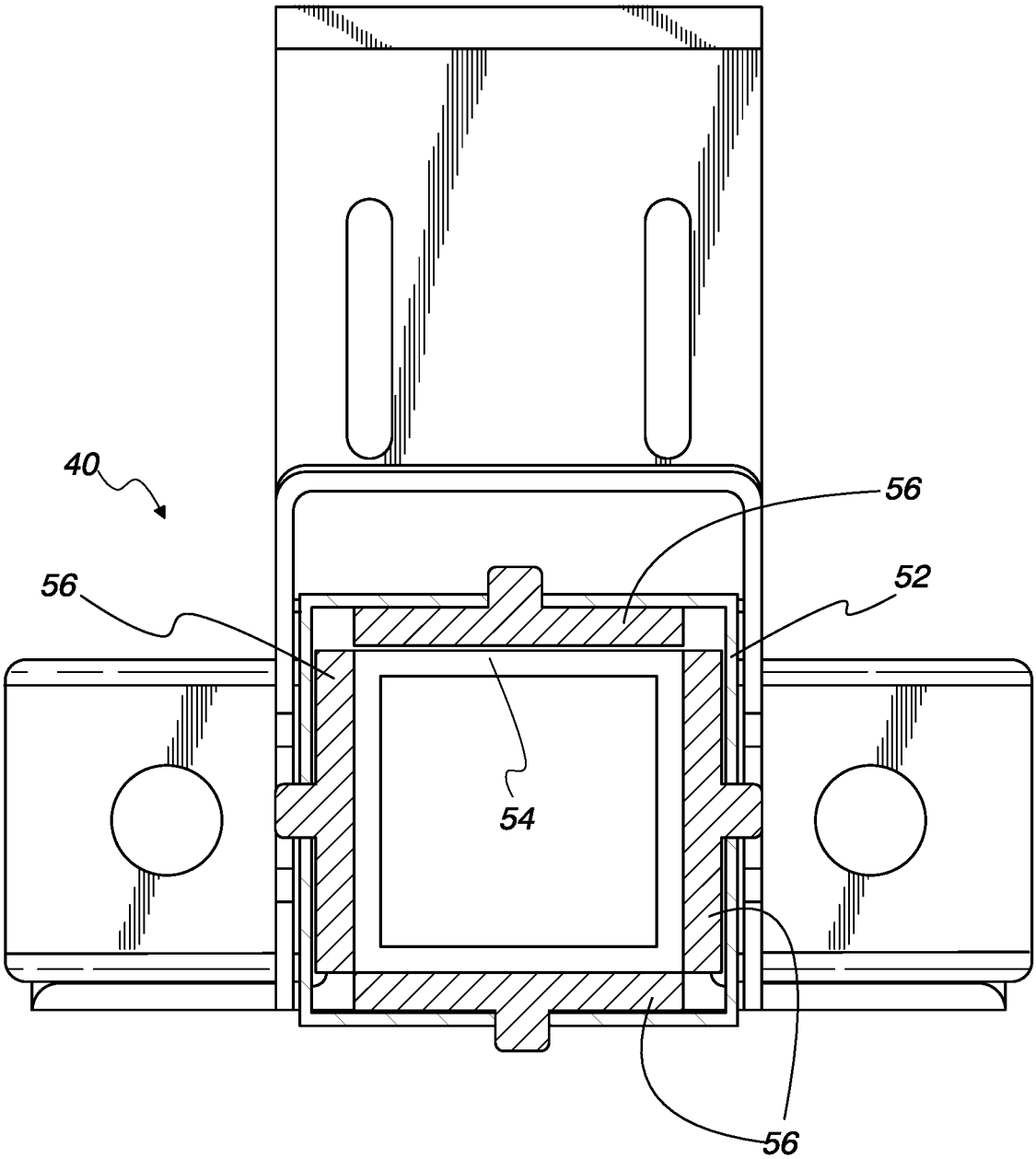
FIG. 8 is a cross-sectional end view of a telescoping assembly of the expandable pontoon boat of FIG. 1A showing wear pads disposed between inner and outer tubes thereof.

As shown in FIG. 8, a plurality of wear pads 56 may be disposed between the inner tube 54A and the outer tube 52A. The wear pads 56 may be attached to the inner tube 54A and bear against the outer tube 52A in sliding engagement therewith. Alternatively, one or more of the wear pads 56 may be attached to the outer tube 52A and bear against the inner tube 54A in sliding engagement therewith. In an embodiment, each of the inner tube 54A and the outer tube 52A may have a rectangular cross section defining four faces, each face being perpendicular to the two adjacent faces, and forty-eight (or more or fewer) wear pads 56 may be attached to the inner tube (twelve (or more or fewer) on each of the four faces of the inner tube), in sliding and bearing engagement with the corresponding interior faces of the outer tube. As shown, each of the wear pads 56 may be embodied as a button having a bearing portion and shaft portion, the shaft portion extending through and retained within a corresponding aperture extending through the corresponding one of the inner tube 54A and the outer tube 52A. Each of the wear pads 56 may be coated with a lubricious material or made of an inherently lubricious material or another material facilitating sliding of the inner tube 54A with respect to the outer tube 52A.

A first actuator 58A is operably associated with the first telescoping assembly 40A. The first actuator 58A is operable to extend the inner tube 54A of the first telescoping assembly 40A from, and retract the inner tube into, the outer tube 52A of the first telescoping assembly. A second actuator 58B is similarly operably associated with the second telescoping assembly 40B. A third actuator 58C is similarly operably associated with the third telescoping assembly 40C. A fourth actuator 58D is similarly operably associated with the fourth telescoping assembly 40D.

Figure 4A:
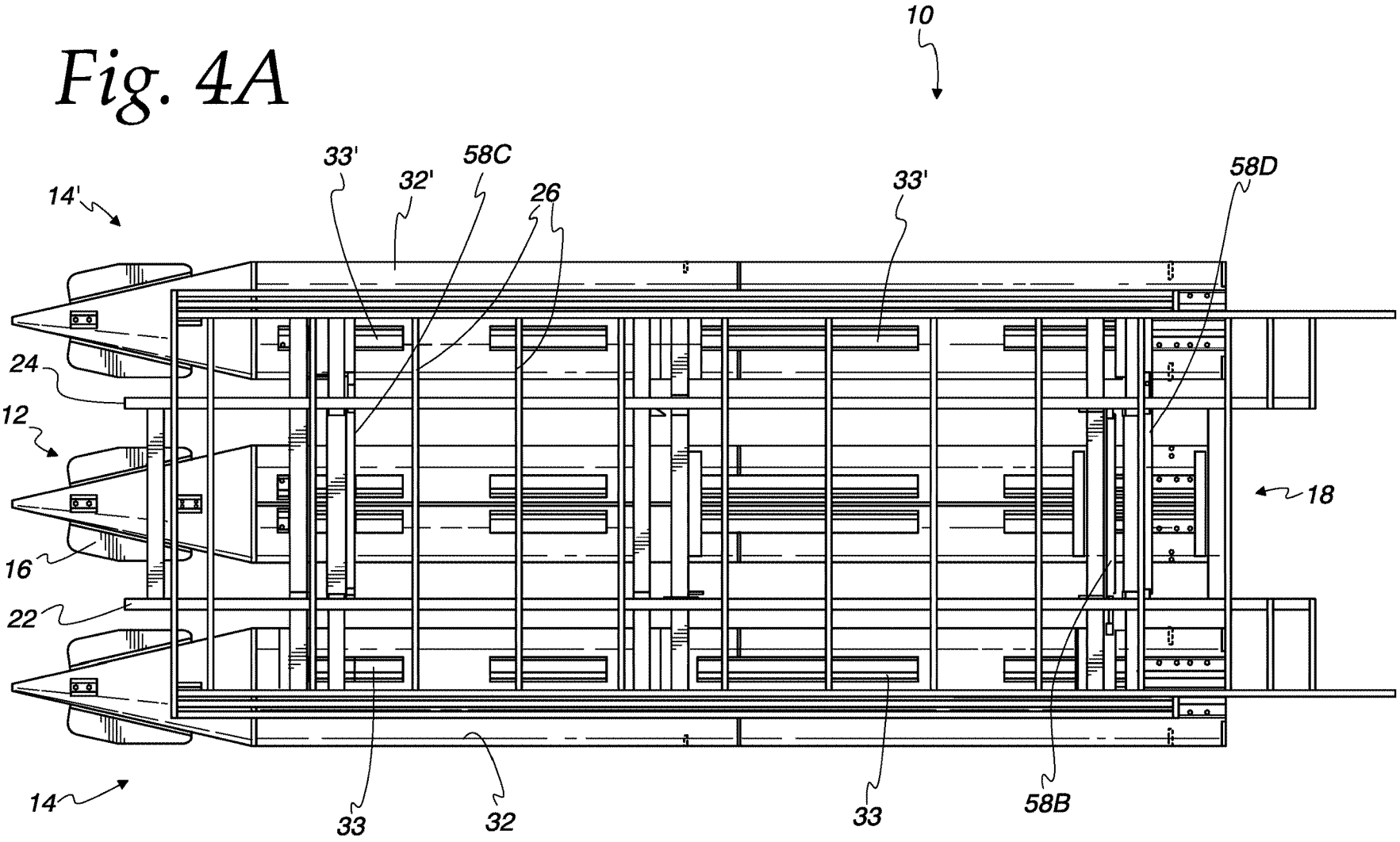
FIG. 4A is a top plan view of the expandable pontoon boat of FIG. 1A in a collapsed configuration with the decking removed for clarity.
Figure 4B:
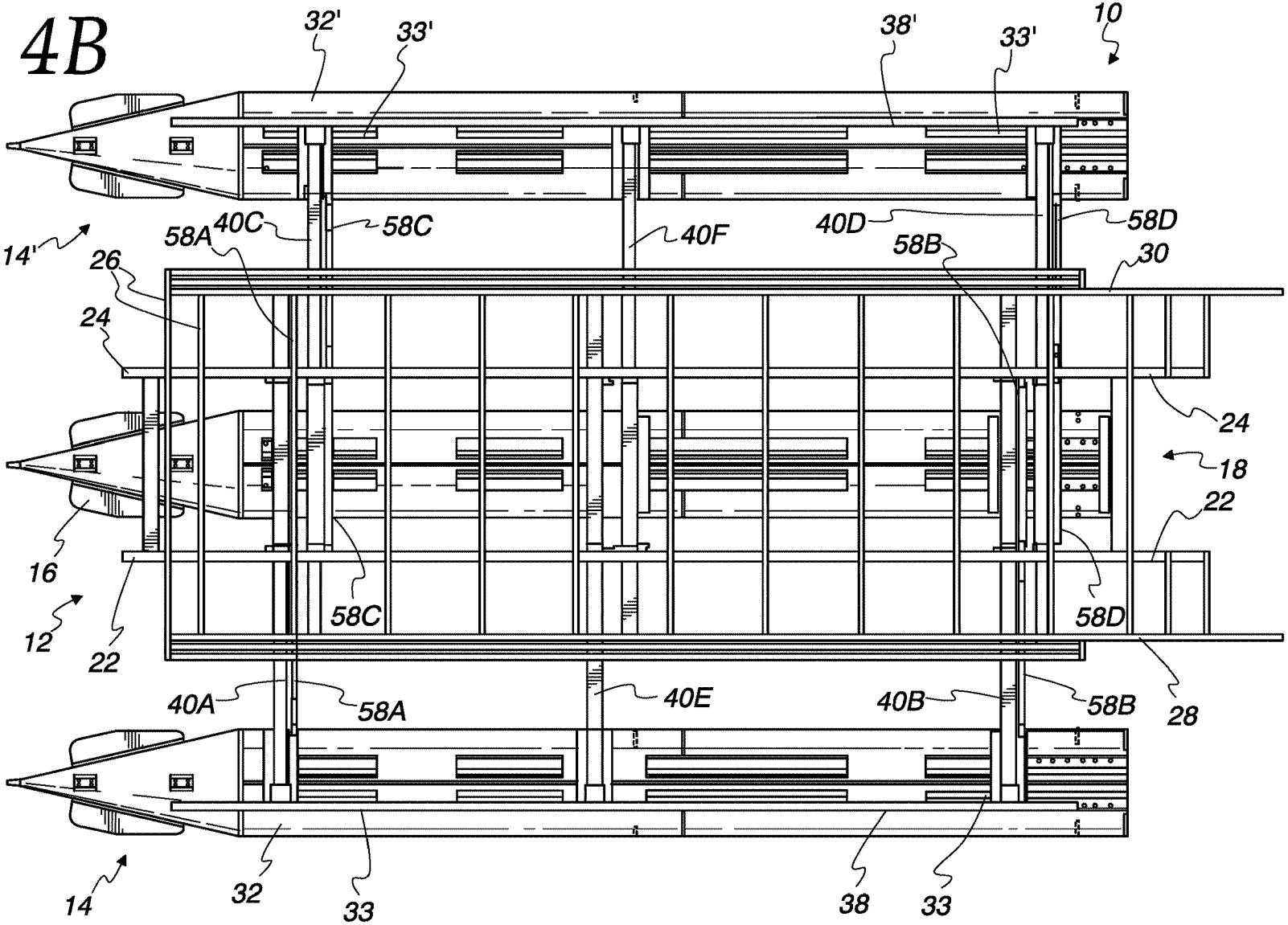
FIG. 4B is a top plan view of the expandable pontoon boat of FIG. 1A in an expanded configuration with the decking removed for clarity.
Figure 5:
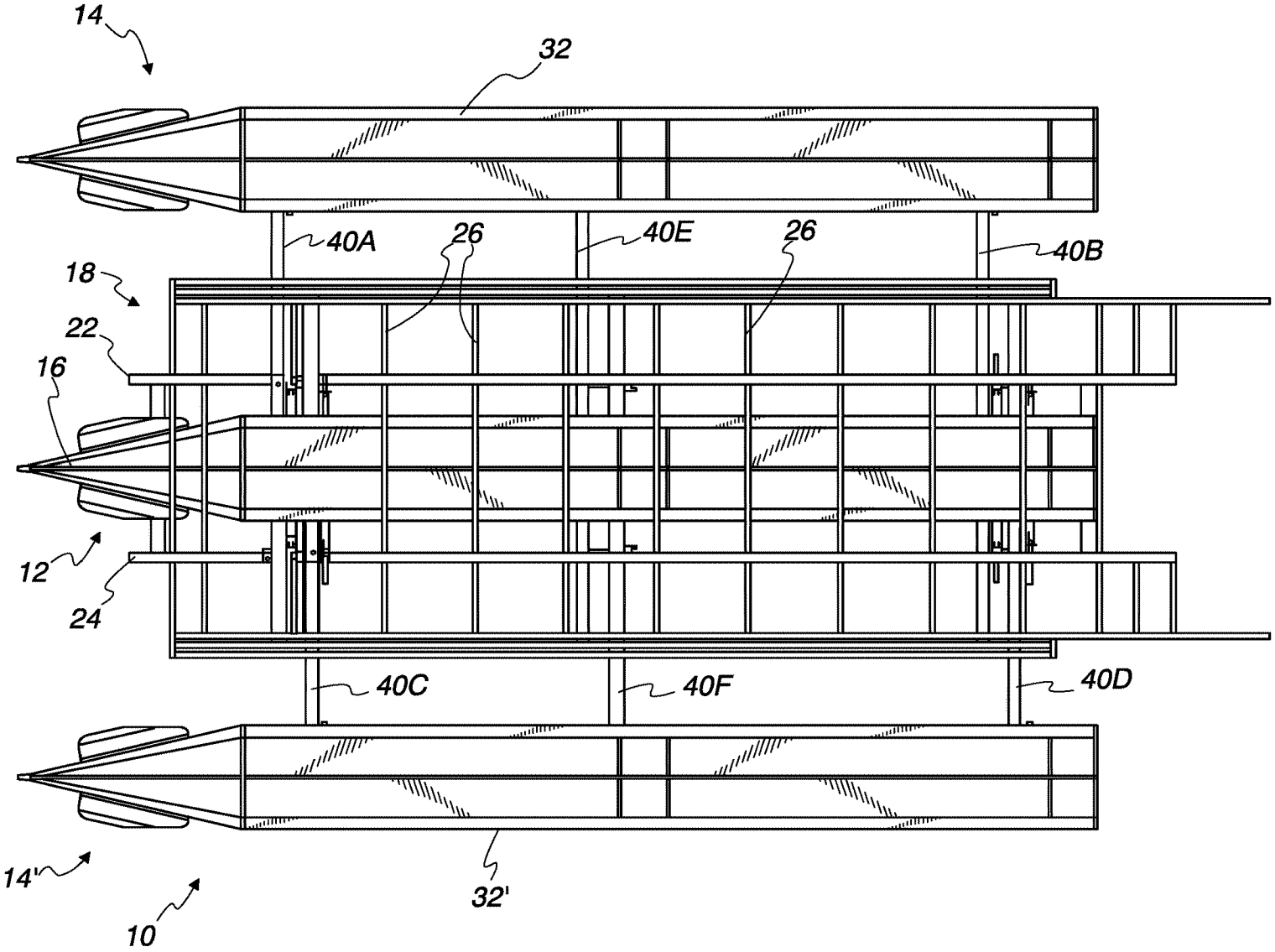
FIG. 5 is a bottom plan view of the expandable pontoon boat of FIG. 1A in a collapsed configuration with the decking removed for clarity.
Figure 6:
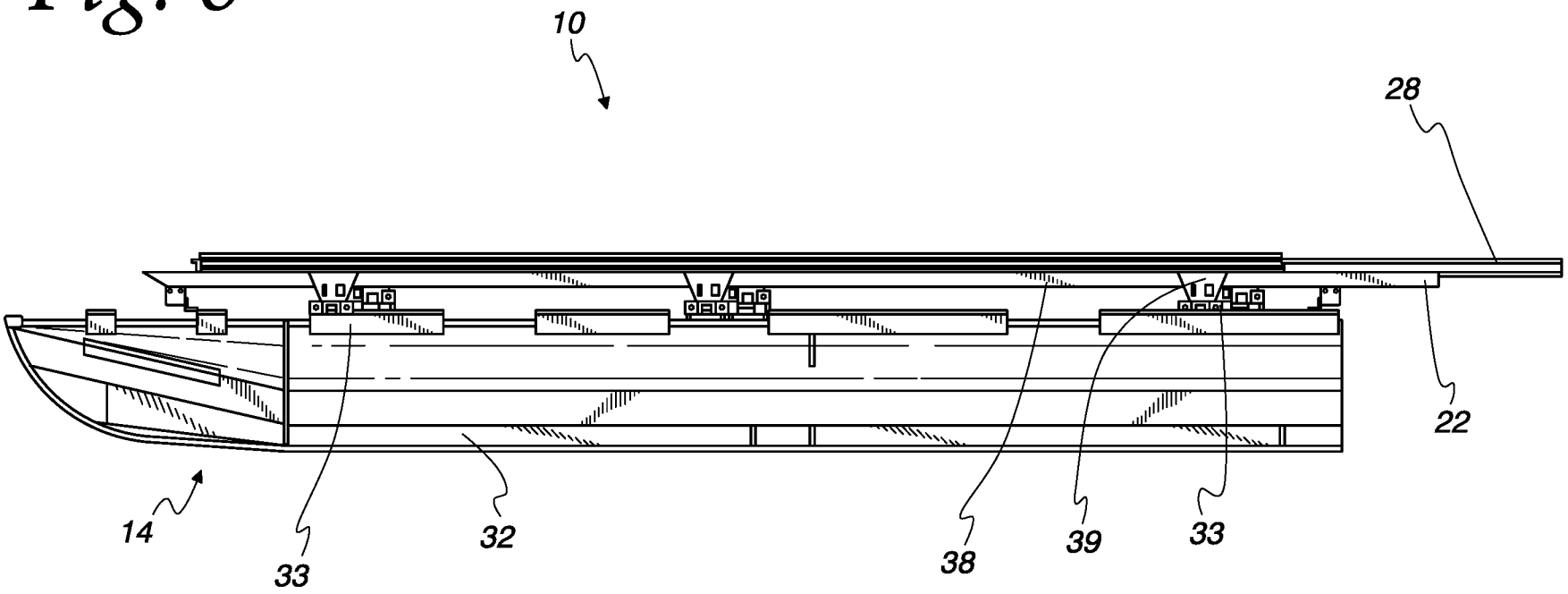
FIG. 6 is a side elevation view of the expandable pontoon boat of FIG. 1A in a collapsed configuration with the decking removed for clarity.
Figure 7A:
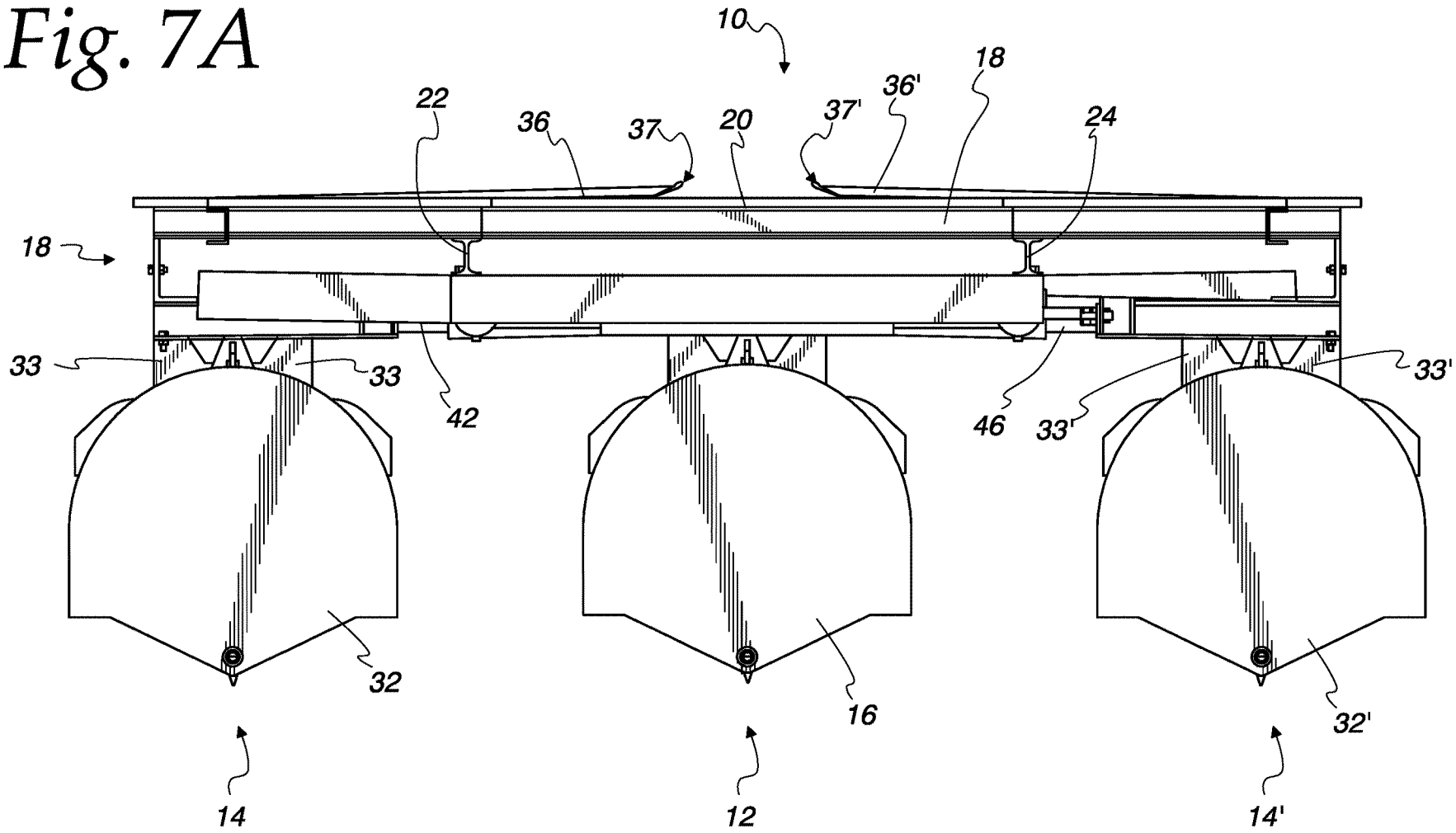
FIG. 7A is a rear elevation view of the expandable pontoon boat of FIG. 1A in a collapsed configuration.
Figure 7B:
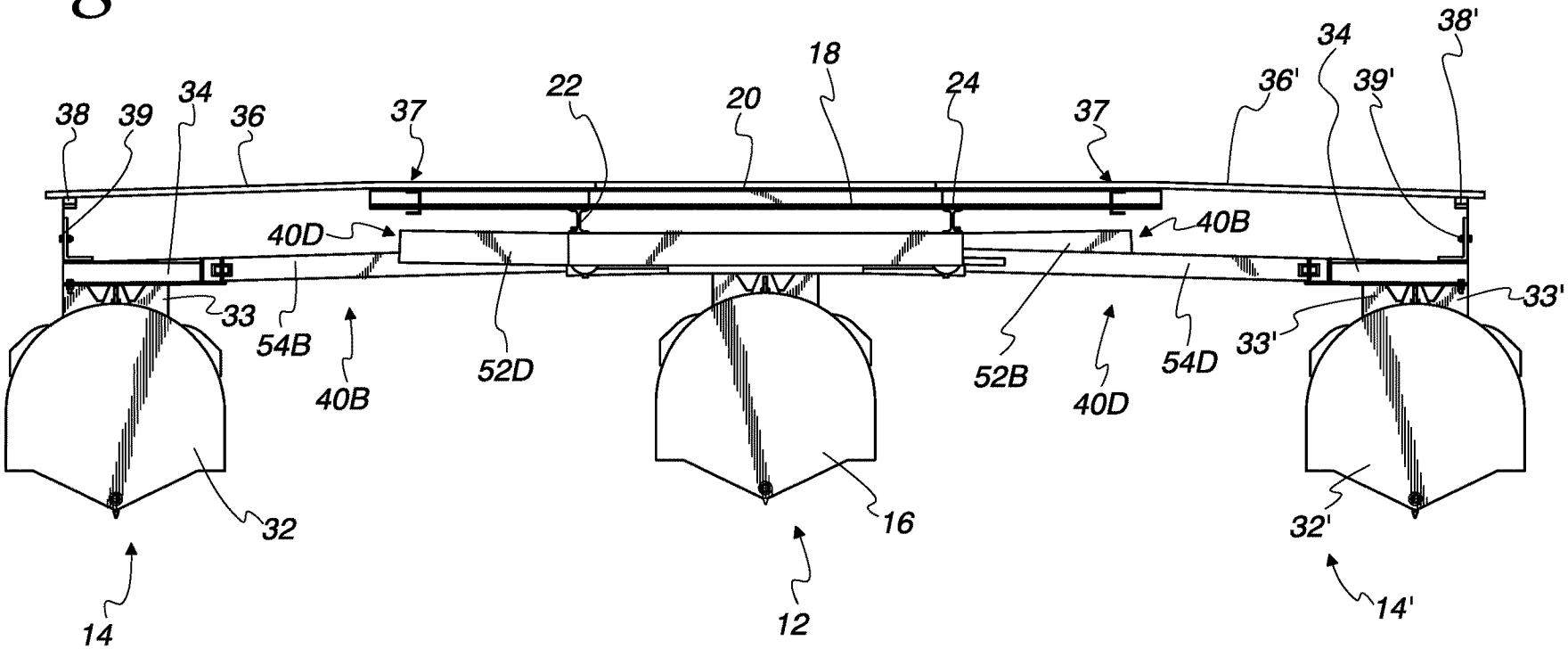
FIG. 7B is a rear elevation view of the expandable pontoon boat of FIG. 1A in an expanded configuration.

As best shown in FIGS. 4A and 4B, each of the first through fourth actuators 58A, 58B, 58C, 58D may be a linear actuator having a first end and a second end. For example, each of the first through fourth actuators 58A, 58B, 58C, 58D may be a linear hydraulic or pneumatic actuator.

In the illustrated embodiment, the first actuator 58A (the first actuator is partially obscured in the drawings) is a linear hydraulic actuator connected at its first end to the outer tube 52A and at its second end to the corresponding port pontoon mounting sleeve 34 (to which the inner tube 54A is operably connected). More specifically, the first actuator 58A may include a piston rod connected to a piston slidingly received within and telescopically extendable from and retractable into a cylinder. The free end of the piston rod may be connected to the corresponding port pontoon mounting sleeve 34, and the free end of the cylinder may be connected to the corresponding outer tube 52A. Such connections may be direct or through intervening brackets or other structures. The second, third and fourth actuators 58B, 58C, 58D may be similarly configured and installed between the inner and outer tubes 54*n*, 52*n* of the corresponding telescoping assemblies 40B, 40C, 40D.

In the illustrated embodiment, each of the fifth and sixth telescoping assemblies 40E, 40F is passive. That is, each of the fifth and sixth telescoping assemblies 40E, 40F lacks an actuator operably connected between the corresponding outer and inner tubes 52*n*, 54*n* thereof for driving the inner tubes thereof with respect to the outer tubes thereof. In an embodiment, either or both of the fifth and sixth telescoping assemblies 40E, 40F could be active. That is, either or both of the fifth and sixth telescoping assemblies 40E, 40F could include a corresponding actuator operably connected between the outer tube 52*n* and the inner tube 54*n* thereof for driving the inner tube thereof with respect to the outer tube thereof. Such actuators could be similar to the first actuator 58A and could be similarly connected to the corresponding outer tube 52*n* and to the corresponding port pontoon mounting sleeve 34.

The first and second actuators 58A, 58B may be operated to displace the port section 14 with respect to the center section 12. More specifically, the first and second actuators 58A, 58B may be operated, for example, by extending the pistons thereof from the cylinders thereof, to extend the inner tubes 54A, 54B from the outer tubes 52A, 52B of the first and second telescoping assemblies 40A, 40B, thereby extending the port section 14 from the center section 12. Also, the first and second actuators 58A, 58B may be operated for example, by retracting the pistons thereof from the cylinders thereof, to retract the inner tubes 54A, 54B into the outer tubes 52A, 52B of the first and second telescoping assemblies 40A, 40B, thereby retracting the port section 14 toward the center section 12.

With the port section 14 in the retracted configuration, an inboard portion of the port deck 36 overlies the center deck 20. As the port section 14 is extended away from the center section 12, the port deck 36 is displaced outwardly from the center deck 20. When the port section 14 is fully extended from the center section 12, the inboard portion and inboard end of the port deck 36 may drop with respect to the center deck 20 so that the port deck and the center deck are substantially flush with one another. Also, as set forth above, the outer tubes 52A, 52B, 52E of the telescoping assemblies 40A, 40B, 40E are attached to the center section 12 at an angle so that the corresponding port pontoon 32 and deck supports 38 "drop" with respect to the center section 12 as the inner tubes 54A, 54B, 54E are extended from the outer tubes 52A, 52B, 52E of the telescoping assemblies 40A, 40B, 40E, thereby enabling the flush orientation of the port deck 36 with respect to the center deck 20 when the port section 14 is fully extended from the center section.

A ramp structure 37 may be provided in connection with either or both of the inboard end of the port deck 36 and the corresponding side edge of the center deck 20 to facilitate retraction of the port section 14 if the port deck 36 is flush with the center deck 20. More specifically, the ramp structure 37 facilitates elevation of the port deck 36 with respect to the center deck 20 to enable retraction of the port section 14 with respect to the center section 12 if the port deck is flush with the center deck when the port section is extended.

One or more rollers, guide blocks, or the like (not shown) may be provided to facilitate sliding of the port deck with respect to the center deck and to mitigate a tendency for binding therebetween.

In an embodiment, the actuators 58*n* could be omitted, and the port section 14 could be manually extended from and retracted toward the center section 12.

As set forth above the construction and operation of the starboard section 14' and its connection to the center section 12 are analogous to the construction and operation of the port section 14 and its connection to the center section. As such, the construction and operation of the starboard section 14' and its connection to the center section 12 will not be discussed in further detail herein.

Terms of orientation used herein should be construed in a relative, rather than absolute, sense unless context clearly dictates otherwise.

The present disclosure describes and shows certain illustrative embodiments of an expandable pontoon boat. Features disclosed in connection with any embodiment may be included in any other embodiment to the greatest extent possible. The illustrative embodiments should not be construed to limit the scope of the invention as set forth in the appended claims.

The invention claimed is:

1. A pontoon boat comprising:

a center section having a longitudinal dimension, the center section comprising:

a first main rail extending in a longitudinal dimension;

a second main rail extending in the longitudinal dimension, the second main rail spaced from and parallel to the first main rail;

a plurality of cross members, each of the plurality of cross members connected to upper sides of the first main rail and the second main rail and perpendicular thereto;

a first side rail connected to respective first ends of the plurality of cross members; and a second side rail connected to respective second ends of the plurality of cross members;

a first side section selectively extendable and retractable with respect to the center section, the first side section comprising a first side pontoon; and a second side section selectively extendable and retractable with respect to the center section, the second side section comprising a second side pontoon;

a first telescoping assembly having a first outer tube connected to the first main rail and the second main rail proximate respective first ends thereof, a first inner tube slidingly received within the first outer tube, the first inner tube operably connected to the first side pontoon, and a first actuator operably connected between the first outer tube and the first inner tube and operable to extend and retract the first inner tube with respect to the first outer tube between a first position and a second position;

a second telescoping assembly having a second outer tube connected to the first main rail and the second main rail proximate respective second ends thereof, a second inner tube slidingly received within the second outer tube, the second inner tube operably connected to the first side pontoon, and a second actuator operably connected between the second outer tube and the second inner tube and operable to extend and retract the second inner tube with respect to the second outer tube between a first position and a second position;

a third telescoping assembly having a third outer tube connected to the first main rail and the second main rail proximate respective first ends thereof, a third inner tube slidingly received within the third outer tube, the third inner tube operably connected to the second side pontoon, and a third actuator operably connected between the third outer tube and the third inner tube and operable to extend and retract the third inner tube with respect to the third outer tube between a first position and a second position;

a fourth telescoping assembly having a fourth outer tube connected to the first main rail and the second main rail proximate respective second ends thereof, a fourth inner tube slidingly received within the fourth outer tube, the fourth inner tube operably connected to the second side pontoon, and a fourth actuator operably connected between the fourth outer tube and the fourth inner tube and operable to extend and retract the fourth inner tube with respect to the fourth outer tube between a first position and a second position;

wherein each of the first and second telescoping assemblies is reciprocable between a first position in which the first side pontoon is relatively near the center section and a second position in which the first side pontoon is relatively far from the center section, and wherein each of the third and fourth telescoping assemblies is reciprocable between a first position in which the second side pontoon is relatively near the center section and a second position in which the second side pontoon is relatively far from the center section.

2. The pontoon boat of claim 1 further comprising a center deck overlying and supported by the plurality of cross members.

3. The pontoon boat of claim 2, the first side section further comprising a first side deck having a first end operably connected to the first side pontoon, and a second end slidingly engaged with the center deck, a portion of the first side deck overlying the center deck when the first side section is in the first position, and a lesser portion or no portion of the first side deck overlying the center deck when the first side section is in the second position.

4. The pontoon boat of claim 3, the first side deck substantially flush with the center deck when the first side section is in the second position.

5. The pontoon boat of claim 3, the second side section further comprising a second side deck having a first end connected to the second side pontoon, and a second end slidingly engaged with the center deck, a portion of the second side deck overlying the center deck when the second side section is in the first position, and a lesser portion or no portion of the second side deck overlying the center deck when the second side section is in the second position.

6. The pontoon boat of claim 5, the second side deck substantially flush with the center deck when the second side deck is in the second position.

7. The pontoon boat of claim 1 further comprising a plurality of wear pads disposed between the first inner tube and the first outer tube of the first telescoping assembly.

8. The pontoon boat of claim 7 wherein the plurality of wear pads is attached to the first inner tube.

9. The pontoon boat of claim 1 further comprising:

a fifth telescoping assembly having a fifth outer tube connected to the first main rail and the second main rail proximate respective second ends thereof, a fifth inner tube slidingly received within the fifth outer tube, the fifth inner tube operably connected to the first side pontoon; and a sixth telescoping assembly having a sixth outer tube connected to the first main rail and the second main rail proximate respective second ends thereof, a sixth inner tube slidingly received within the sixth outer tube, the sixth inner tube operably connected to the second side pontoon.

10. The pontoon boat of claim 9 further comprising:

a fifth actuator operably connected between the fifth outer tube and the fifth inner tube and operable to extend and retract the fifth inner tube with respect to the fifth outer tube between a first position and a second position; and a sixth actuator operably connected between the sixth outer tube and the sixth inner tube and operable to extend and retract the sixth inner tube with respect to the sixth outer tube between a first position and a second position.

11. A pontoon boat comprising:

a center section having a longitudinal dimension, the center section comprising:

a first main rail extending in a longitudinal dimension;

a second main rail extending in the longitudinal dimension, the second main rail spaced from and parallel to the first main rail;

a plurality of cross members, each of the plurality of cross members connected to upper sides of the first main rail and the second main rail and perpendicular thereto;

a first side rail connected to respective first ends of the plurality of cross members; and a second side rail connected to respective second ends of the plurality of cross members;

a first side section selectively extendable and retractable with respect to the center section, the first side section comprising:

a first side pontoon; and a first side deck connected to the first side pontoon;

a first telescoping assembly having a first outer tube connected to the first main rail and the second main rail proximate respective first ends thereof, a first inner tube slidingly received within the first outer tube, the first inner tube operably connected to the first side pontoon, the first inner tube extendable from and retractable into the first outer tube; and a second telescoping assembly having a second outer tube connected to the first main rail and the second main rail proximate respective second ends thereof, a second inner tube slidingly received within the second outer tube, the second inner tube operably connected to the first side pontoon, the second inner tube extendable from and retractable into the second outer tube.

12. The pontoon boat of claim 11, further comprising:

a first actuator operably connected between the first outer tube and the first inner tube and operable to extend and retract the first inner tube with respect to the first outer tube between a first position and a second position; and a second actuator operably connected between the second outer tube and the second inner tube and operable to extend and retract the second inner tube with respect to the first outer tube between a first position and a second position.

13. The pontoon boat of claim 11 further comprising a center deck overlying and supported by the plurality of cross members.

14. The pontoon boat of claim 13, the first side section further comprising a first side deck having a first end operably connected to the first side pontoon, and a second end slidingly engaged with the center deck, a portion of the first side deck overlying the center deck when the first side section is in the first position, and a lesser portion or no portion of the first side deck overlying the center deck when the first side section is in the second position.

15. The pontoon boat of claim 14, the first side deck substantially flush with the center deck when the first side section is in the second position.

16. The pontoon boat of claim 11 further comprising:

a second side section selectively extendable and retractable with respect to the center section, the second side section comprising a second side pontoon;

a third telescoping assembly having a third outer tube connected to the first main rail and the second main rail proximate respective first ends thereof, a third inner tube slidingly received within the third outer tube, the third inner tube operably connected to the second side pontoon, the third inner tube extendable from and retractable into the third outer tube; and a fourth telescoping assembly having a fourth outer tube connected to the first main rail and the second main rail proximate respective second ends thereof, a fourth inner tube slidingly received within the fourth outer tube, the fourth inner tube operably connected to the second side pontoon, the fourth inner tube extendable from and retractable into the fourth outer tube.

17. The pontoon boat of claim 16 further comprising:

at least one actuator operable to extend the corresponding inner tube of a corresponding at least one of the first, second, third and fourth telescoping assemblies from the corresponding outer tube of the corresponding at least one of the first, second, third and fourth telescoping assemblies, and to retract the corresponding inner tube of the corresponding at least one of the first, second, third and fourth telescoping assemblies into the corresponding outer tube of the corresponding at least one of the first, second, third and fourth telescoping assemblies.

* * * * *